US007204399B2

(12) United States Patent
Collier et al.

(10) Patent No.: US 7,204,399 B2
(45) Date of Patent: Apr. 17, 2007

(54) COMPRESSION SYSTEM FOR BACKPACK

(75) Inventors: Michael Collier, Portland, OR (US); Frank T. Brown, Beaverton, OR (US); Thomas G. Bell, Portland, OR (US)

(73) Assignee: Nike, Inc., Beaverton, OR (US)

( * ) Notice: Subject to any disclaimer, the term of this patent is extended or adjusted under 35 U.S.C. 154(b) by 496 days.

(21) Appl. No.: 10/702,223

(22) Filed: Nov. 5, 2003

(65) Prior Publication Data

US 2005/0092803 A1 May 5, 2005

(51) Int. Cl.
*A45F 3/04* (2006.01)

(52) U.S. Cl. ..... 224/631; 224/627; 224/153; 224/259; 224/645

(58) Field of Classification Search ..... 224/640, 224/639, 641, 645, 153, 578, 631, 259
See application file for complete search history.

(56) References Cited

U.S. PATENT DOCUMENTS 1,397,161 A * 11/1921 Clemetson ..... 224/579
1,696,191 A * 12/1928 Coulson ..... 224/627
2,262,313 A * 11/1941 Clappier ..... 224/655
5,431,317 A * 7/1995 Kliot ..... 224/153
6,024,265 A 2/2000 Clements ..... 224/630
6,164,509 A 12/2000 Gausling et al. ..... 224/627
6,179,187 B1 1/2001 Lemire et al. ..... 224/640
6,286,461 B1 * 9/2001 Martz ..... 119/497
2002/0139821 A1 * 10/2002 Fleischli ..... 224/153

FOREIGN PATENT DOCUMENTS

FR 2 677 235 12/1992
GB 2 343 618 5/2000

* cited by examiner

*Primary Examiner*—Tri M. Mai
(74) *Attorney, Agent, or Firm*—Banner & Witcoff, Ltd.

(57) ABSTRACT

A backpack with a compression system includes a backpack body having a top side, a bottom side, two lateral sides, a body side, an outer side and a pair of shoulder straps. Each shoulder strap has a first end connected at a junction of the top side and the body side, and a second end connected to the backpack body at a junction of the bottom side and the body side. Each strap extends along a corresponding lateral side and the bottom of the backpack body, and is slidably connected to the backpack body at a junction of the body side and a corresponding lateral side, and at a junction of the corresponding lateral side and the outer side.

28 Claims, 10 Drawing Sheets

COMPRESSION SYSTEM FOR BACKPACK

FIELD OF THE INVENTION

This invention relates generally to backpacks, and, in particular, to backpacks having compression systems that compress the contents of the backpack and minimize stresses presented to the wearer.

BACKGROUND OF THE INVENTION

Backpacks for day use are well known, and their use has increased dramatically in recent years. Frameless backpacks rely on shoulder straps, and, optionally, hip straps, to carry the load. These backpacks are used for day hiking and other outdoor recreational activities, as well as by students for carrying books and supplies between school and home. Many students today need to carry more books and supplies than they have in the past due to the emphasis being placed on improving schools and the quality of education afforded young people, resulting in heavy loads being carried in the students' backpacks.

Along with the heavier loads being carried more frequently by these frameless packs comes the increased potential for fatigue, discomfort, poor posture, and even musculoskeletal disorder and injury. This places a premium on backpack design to minimize such potential. However, the suspension systems in many such backpacks are simply incapable of providing an ergonomically correct fit. A backpack with standard shoulder straps primarily carries the load on the shoulders. However, the more a load can ride on the hips, the less load pressure there is on the shoulders. Further, the closer the load is to the back of the user, the more upright the user is able to walk, and, consequently, there is less pressure on the hip joints.

If the load in the backpack is compressed, it has less tendency to shift around when the user is moving, jumping, or bending over. The more a load moves, the more the body has to work and move to compensate for the load shifting. The more the body has to move and work to compensate, the greater the chance for injury or body stress. Thus it would be desirable to provide a backpack that moves the load closer to the back and in the direction of the lower back and hips, and also helps to stabilize the load in the backpack.

U.S. Pat. No. 6,164,509 to Gausling et al. discloses a backpack with a shoulder strap secured at one end to a top edge of a body side panel of the backpack. The strap extends across a lower portion of a lateral side of the backpack, and is secured to the backpack at a junction between the lateral side and an outer side of the backpack. Another strap is connected at its first end to the shoulder strap, extends beneath the backpack body, and is connected at its other end to a junction between the bottom of the backpack body and the outer side of the backpack body. The weight of the contents of the backpack act to compress the outer side of the backpack body toward the body when the back is placed on a user's shoulders, thereby shifting the weight closer to the user's back. Gausling is limiting in that it has a complicated construction requiring excessive straps, and, therefore, one that has increased manufacturing costs and potential for functional and maintenance problems.

It is an object of the present invention to provide an improved backpack that reduces or overcomes some or all of the difficulties inherent in prior known devices. Particular objects and advantages of the invention will be apparent to those skilled in the art, that is, those who are knowledgeable or experienced in this field of technology, in view of the following disclosure of the invention and detailed description of certain preferred embodiments.

SUMMARY

The present invention is directed to a backpack with a compression system that is efficient and effective in minimizing the stresses presented to a wearer using a loaded backpack, and, therefore, allows the wearer to carry heavier loads for a longer period of time with reduced fatigue and discomfort.

In accordance with a first aspect, a backpack with a compression system includes a backpack body having a top side, a bottom side, two lateral sides, a body side, an outer side, and a pair of shoulder straps. Each shoulder strap has a first end connected at a junction of the top side and the body side, and a second end connected to the backpack body at a junction of the bottom side and the body side. The straps extend along a corresponding lateral side and the bottom of the backpack body, and are slidably connected to the backpack body at a junction of the body side and a corresponding lateral side, and at a junction of the corresponding lateral side and the outer side.

In accordance with another aspect, a backpack with a compression system includes a backpack body having a top side, a bottom side, two lateral sides, a body side, an outer side, and a compression assembly. The compression assembly includes a pair of shoulder straps and a compression member. Each shoulder strap has a first end connected at a junction of the top side and the body side, and a second end connected to the backpack body at a junction of the bottom side and the body side. The straps extend along a corresponding lateral side and the bottom of the backpack body, and are slidably connected to the backpack body at a junction of the body side and a corresponding lateral side, and at a junction of the corresponding lateral side and the outer side. The compression member is positioned adjacent an outer surface of the outer side and is secured to each of the shoulder straps.

In accordance with another aspect, a backpack with a compression system includes a backpack body having a top side, a bottom side, two lateral sides, a body side and an outer side, and a pair of shoulder straps. Each shoulder strap has a first end connected at a junction of the top side and the body side, and a second end connected to the backpack body at a junction of the bottom side and the body side. Each shoulder strap extends along a corresponding lateral side and the bottom of the backpack body, and is slidably connected to the backpack body at a junction of the body side and a corresponding lateral side, and at a junction of the corresponding lateral side and the outer side such that the lateral sides will automatically compress and a portion of each shoulder strap between the first end and the junction of the body side and the corresponding lateral side will lengthen when the loaded backpack is lifted.

Substantial advantage is achieved by providing a backpack with a compression system as described herein. In particular, a backpack with a compression system automatically compresses the load in the pack, shifting the load closer to the wearer's lower back and hips. Thus, such a backpack maximizes wearer comfort and health, even when the pack is fully loaded.

These and additional features and advantages of the invention disclosed here will be further understood from the following detailed disclosure of certain preferred embodiments.

Figure 1:
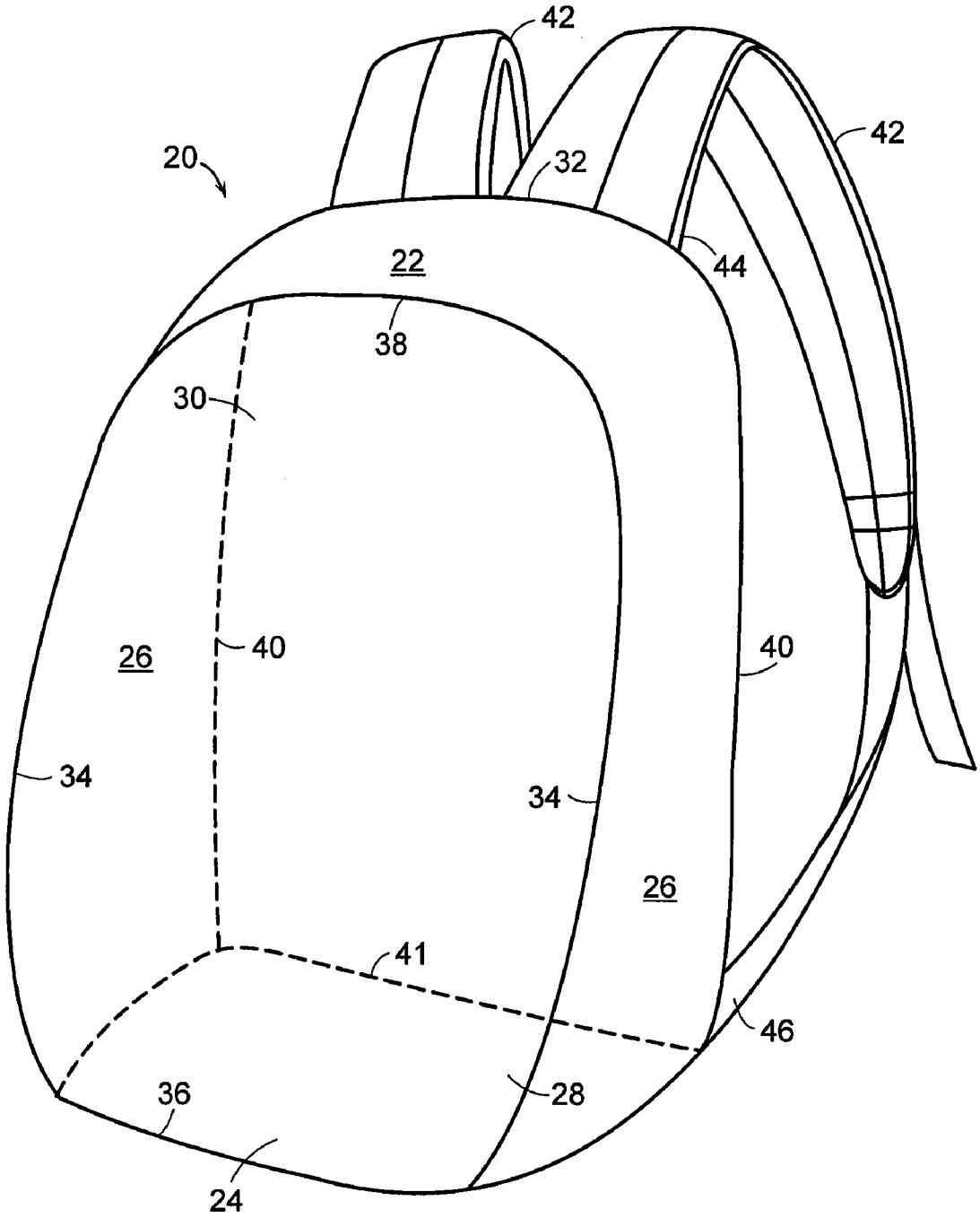
FIG. 1 PRIOR ART
FIG. 1 is a perspective view of a backpack of the prior art.

The figures referred to above are not drawn necessarily to scale and should be understood to present a representation of the invention, illustrative of the principles involved. Some features of the backpack with a compression system depicted in the drawings have been enlarged or distorted relative to others to facilitate explanation and understanding. The same reference numbers are used in the drawings for similar or identical components and features shown in various alternative embodiments. Backpacks with compression systems as disclosed herein, would have configurations and components determined, in part, by the intended application and environment in which they are used.

DETAILED DESCRIPTION OF CERTAIN PREFERRED EMBODIMENTS

A typical backpack body 20 of the prior art is shown in FIG. 1, and is formed by a number of panels or sides. The reference numbers used for many of the elements of backpack body 20 are used for similar or identical components of preferred embodiments of the present invention described below.

Backpack body 20 has a top side or region 22, a bottom side or region 24, two lateral sides or regions 26, an outer side or region 28, and a body side or region 30. Separating the various panels or side regions is a series of junctions or seams. When connected, these six panel regions define an interior compartment in backpack body 20 into which cargo such as books, food, clothing, etc. may be stowed. Of course, this interior compartment may be subdivided into, or complemented with, a number of additional compartments or regions for keeping various items separate. This allows a user to more efficiently pack and organize the backpack, which can provide for better access to important items, as well as distribute the load properly in the backpack. Although such a six-panel configuration is not necessary, it is helpful in helping to describe the features and advantages of the present invention.

Although six particular sides or panels are described, backpack body 20 can comprise fewer panels or sides, and have correspondingly fewer seams or junctions, and be within the scope of the invention. For instance, the body, top, bottom, outer, and lateral sides could be formed of one continuous piece of fabric with no actual seams or junctions, and such a construction is to be considered within the scope of the present invention. In such a case, backpack body 20 could still be described as having a number of seams or junctions, which would aid in understanding the relative location on backpack body 20 being discussed. Alternatively, backpack body 20 could have more than six panels or sides and corresponding seams or junctions, and such a configuration is also considered to be within the scope of the invention.

A first junction 32 is defined between top panel 22 and body side 30. Second junctions 34 are similarly disposed in the regions between the outer side 28 and the two lateral sides 26. A third junction 36 defines a transition region between the bottom panel 24 and the outer side 28, and a fourth junction 38 is disposed generally between the outer side 28 and the top panel or side 22. Fifth junctions 40 are disposed between lateral sides 26 and body side 30. Sixth junctions 41 are disposed between body side 30 and bottom panel 24.

These various seams or junctions described herein are meant to define a region as opposed to a specific location on body 20. Thus, first junction 32 between top side 22 and body side 30 is meant only to define a general region of transition between these two sides 22 and 30. One may move as many as several inches away from the first junction 32 into the region of the top side 22 or body side 30, or anywhere along the line shown in the figures as defining these junctions, and still be within the scope of the term junction. Consequently when corresponding elements of the backpack are described as being connected to, or disposed at, a junction, it is to be appreciated that the point of connection or disposal is in a region at or near the particular junction, and need not be exactly connected to or disposed at that junction.

Thus, junctions can comprise a general transition region from one section of backpack body 20 to another without any discontinuity in the panel or side. For instance, a junction can generally define a region where the panels or sides transition from one orientation to another, particularly when backpack body 20 is loaded with contents. Thus, a junction can be merely a bend in backpack body 20.

Alternatively, the junctions can be a distinct part of backpack body 20, such as a seam formed by sewing, or any other type of permanent bonding or fusing of the two sides. Further, a junction can be a temporary seam along or near which a body compartment can be opened and closed. In the latter case, a junction can represent an area near a nylon or metal zipper, a hook and loop-type fastener, snaps, buttons, and the like.

The discussion and designation of the various components of a preferred embodiment of a backpack body 20 shown in FIG. 2, including the panels or sides and their corresponding seams as described below, are simplified so that the advantages of the present invention can be particularly described. For instance, it is within the scope of the invention that although backpack body 20 defines a compartment into which cargo such as books, clothing, food, etc.

may be placed, additional compartments and features such as outer and side compartments, loops, etc. may be added to backpack body 20.

In the backpack body of FIG. 1, a pair of shoulder straps 42 are secured at first ends 44 thereof to backpack body 20 proximate first junction 32 (hidden from view here) by stitching or other suitable means. A second end 46 of each shoulder strap 42 is secured by stitching or other suitable means to fifth junction 40 proximate a lower end of backpack body 20. Shoulder straps 42 serve to support the weight of the backpack on the shoulders of the user in known fashion.

The panels making up backpack body 20, as well as the straps and other components of the invention can variously comprise a number of natural or synthetic materials. Natural fabric such as leather, cotton and the like may be useful for certain applications. Preferred are synthetic fabrics made from thermoplastic materials such as polypropylene, polyvinyl chloride, polyamide (such as nylon), polyethylene, polyester, etc. Especially preferred is nylon that can be textured for breathability, wear-resistance, and waterproofed with materials such as silicone elastomers and the like. Particularly useful is a type of nylon known as Cordura (supplied by E.I. du Pont de Nemours & Co. of Wilmington, Del.). Multiple or composite layer configurations as are well-known in the art, in which a tougher, more durable weave comprises an outer layer, while a lighter, thinner, and more flexible inner weave comprises an inner layer. Some of these materials known in the industry, such as Gore-Tex (supplied by W.L. Gore & Associates of Newark, Del.), Tri-Shield (supplied by Tri-Seal International of Blauvelt, N.Y.), Spandura (provided by H. Warsaw & Sons of New York, N.Y.), etc. can be used as appropriate.

Figure 2:
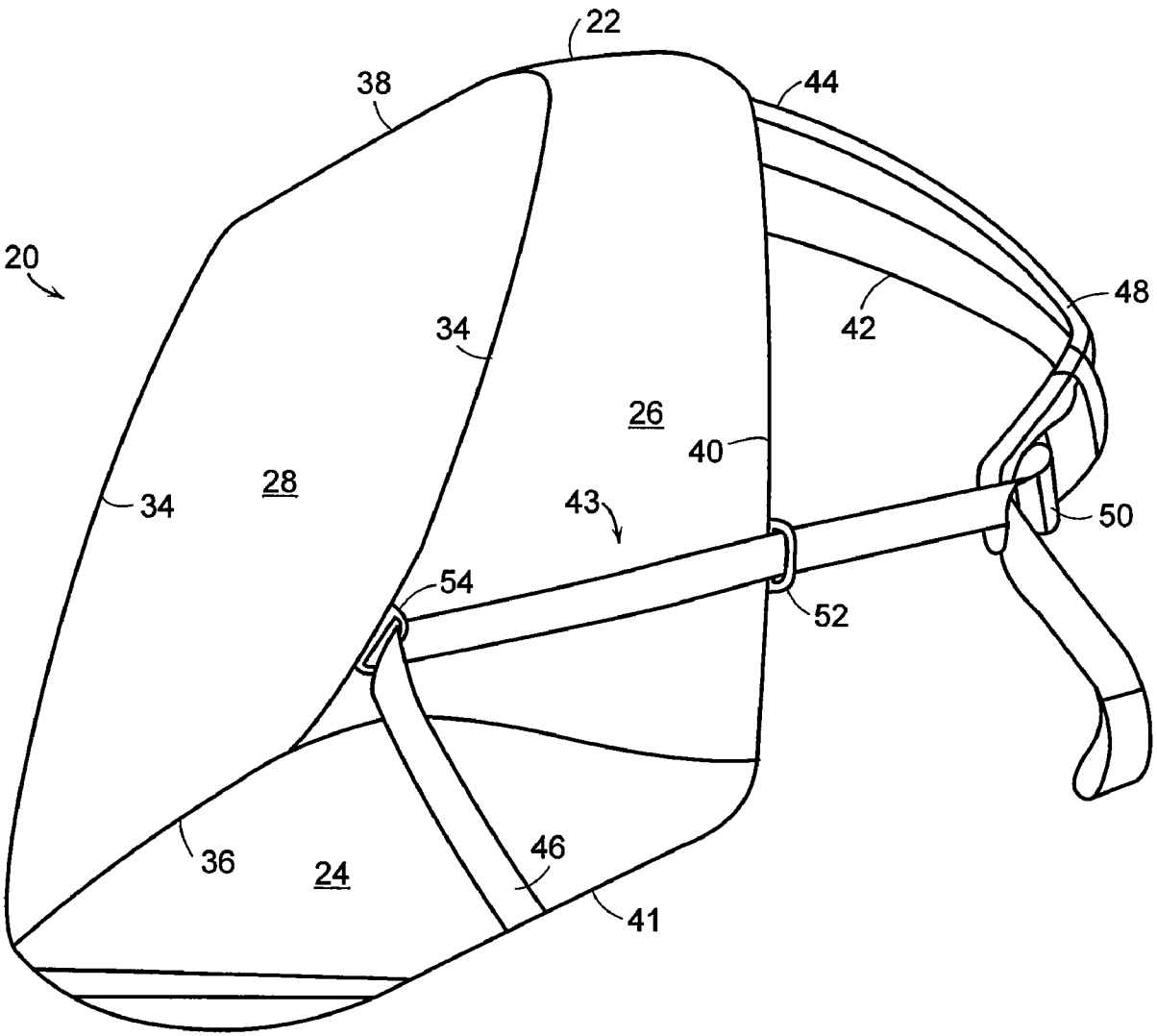
FIG. 2 is a perspective view of a preferred embodiment of a backpack with a compression assembly in accordance with the present invention.

As seen in a preferred embodiment of the present invention shown in FIG. 2, shoulder straps 42 may be provided with padding 48 to improve the comfort and fit for the user. Shoulder straps 42 may also be provided with an adjustable buckle 50. In the illustrated embodiment, the configuration of buckle 50 requires shoulder strap 42 to be formed of two pieces. It is to be appreciated that a shoulder strap, or any other strap described herein, such as a hip strap, formed of more than one piece is considered to be, along with any associated buckle or other adjustable fastener, an integral strap within the scope of the present invention.

Shoulder strap 42 is connected at its first end 44 to backpack body 20 proximate first junction 32. Second end 46 of shoulder strap 42 is connected to backpack body 20 proximate sixth junction 41. Between first end 44 and second end 46, shoulder strap 42 extends along lateral side 26 of backpack body 20 from fifth junction 40 across to second junction 34, and back across bottom panel 24 to sixth junction 41. In a preferred embodiment, shoulder strap 42 is slidably connected to backpack body 20 at fifth junction 40 and second junction 34. In a preferred embodiment, the location at which shoulder strap 42 is slidably connected at fifth junction 40 is at a higher position than the location at which shoulder strap 42 is slidably connected at second junction 34.

In the embodiment illustrated in FIG. 2, shoulder strap 42 is slidably connected to backpack body 20 by way of a first D-ring 52 secured to backpack body 20 at fifth junction 40. Similarly, shoulder strap 42 is slidably connected to backpack body 20 by way of a second D-ring 54 secured to backpack body 20 at second junction 34. D-rings 52, 54 maintain shoulder straps 42 close to lateral sides 26 and provide for load compression of backpack body 20. It is to be appreciated that elements other than D-rings can be provided to allow for sliding movement of shoulder straps 42 along lateral sides 26 such as sleeves or grommets, as discussed below, or any other suitable structure that will allow for sliding movement of the straps.

Figure 3:
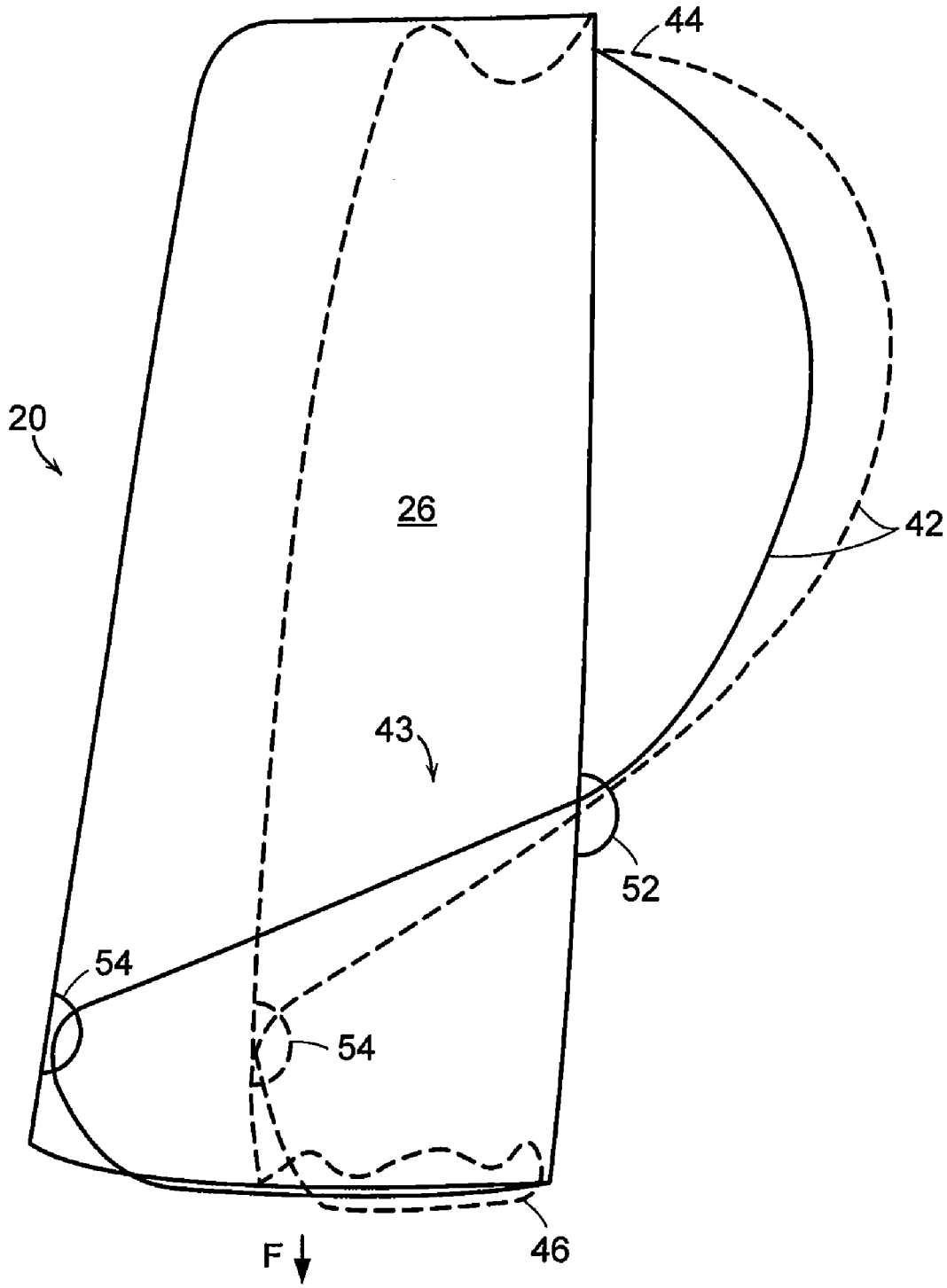
FIG. 3 is a schematic illustration of the automatic compression feature of the compression assembly of FIG. 2.

When the user places the shoulder straps over their shoulders, the load in the backpack is automatically compressed due to the weight of the load, and the fact that shoulder straps 42 are slidably secured to backpack body 20. This is schematically illustrated in FIG. 3, where backpack body 20 is shown in its non-compressed form in solid lines and in its compressed form in dashed lines. When a loaded backpack is picked up, the load in the backpack exerts a downward force in the direction of arrow F, causing the portions of shoulder straps 42 between first end 44 and D-ring 52 to lengthen, and the portion between second end 46 and D-ring 52 to shorten as the lateral sides 26 of backpack body 20 are compressed. This compression happens automatically as a function of the construction of compression assembly 43 when the user lifts the backpack. Any adjustment of shoulder straps 42 by the user is for comfort only.

Compression of the load in backpack body 20 advantageously moves the load closer to the user's lower back and hips, which is a more secure and appropriate place for the load to be supported than on the shoulders. Similarly, slidably securing shoulder straps 42 along lateral sides 26 allows expansion of the backpack body for easy loading.

By configuring shoulder straps 42 such they extend along lateral sides 26 and bottom panel 24, automatic compression of backpack body 20 is accomplished with a continuous loop, while simultaneously providing additional support under bottom panel 24 by way of shoulder straps 42. The center of gravity of backpack body 20 is advantageously moved lower and closer to the user's hips and lower back, allowing the user to more comfortably and easily carry a load.

In a preferred embodiment, first D-ring 52 is secured to backpack body 20 at a point higher than the point at which second D-ring 54 is secured to backpack body 20. Such a construction allows shoulder strap 42 to more easily slide through the D-rings as the load in the backpack is compressed. As illustrated here, it is preferred that second D-ring 54 be secured close to the bottom of backpack body 20, although it should be realized that it could be attached up to several inches or more above the bottom of backpack body 20. D-rings 52 and 54 may be disposed at different angles, depending on their relative orientation with respect to one another and backpack body 20, in order to ensure that shoulder strap 42 can pass through the D-rings with the least amount of resistance.

Figure 4:
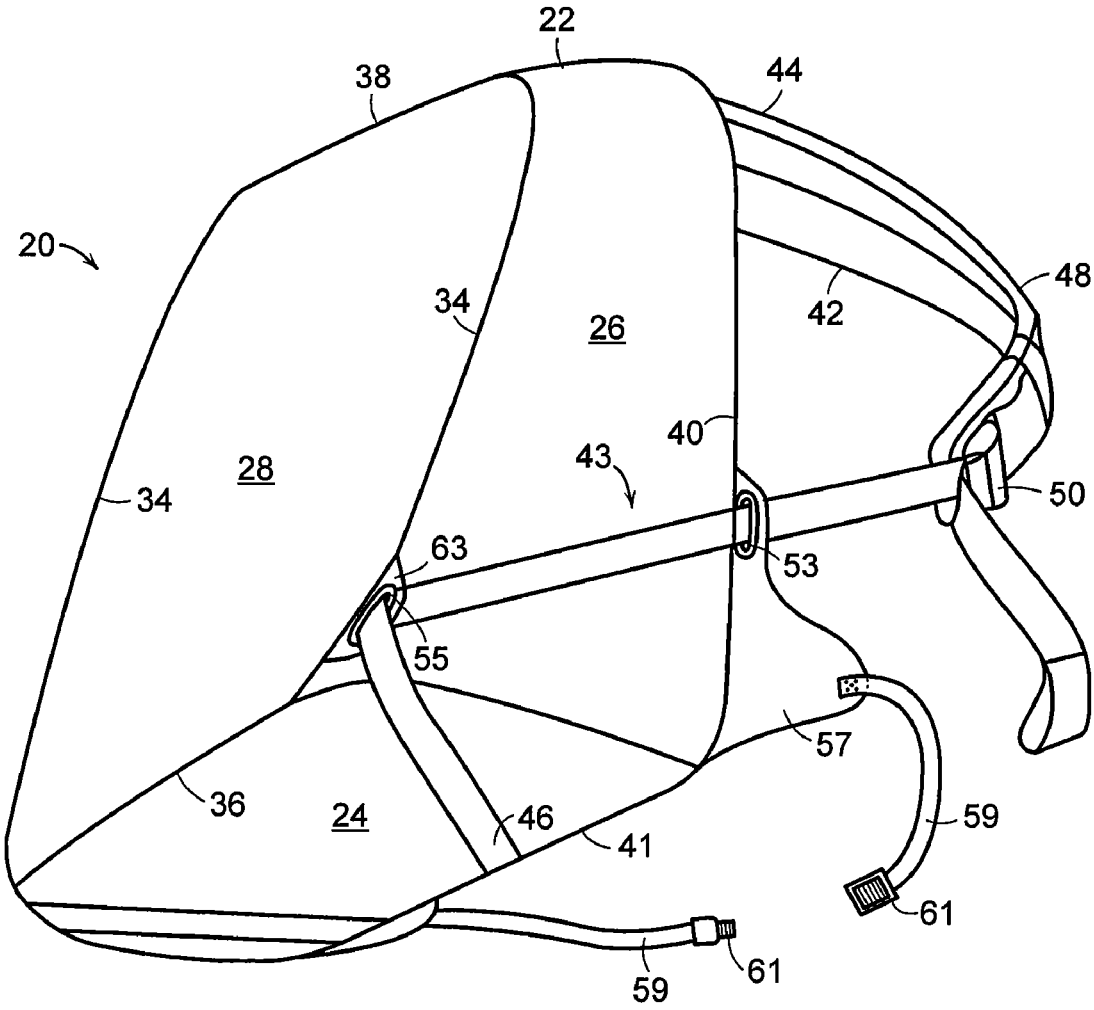
FIG. 4 is a perspective view of the backpack of FIG. 2, with an alternative embodiment of a compression assembly in accordance with the present invention.

Another preferred embodiment of compression assembly 43 is shown in FIG. 4, in which shoulder strap 42 is slidably secured by way of first and second grommets 53, 55, which are secured to backpack body 20 proximate fifth junction 40 and third junction 34, respectively. In the embodiment shown here, grommet 53 is disposed in a hip portion 57 of backpack body that extends from fifth junction 40. An optional hip strap 59, having an adjustable buckle 61 is secured by stitching or other suitable means to hip portion 57. As noted above and illustrated here, hip strap 59 may be formed of two separate portions. Grommet 55 is shown here secured to a flange member 63, which in turn is secured to third junction 34 by stitching or other suitable means. Grommets 53, 55 may be formed of plastic, metal or any other suitable material. Plastic grommets may be sewn or press-fit to backpack body 20, while metal grommets may be press-fit to backpack body 20.

Figure 5:
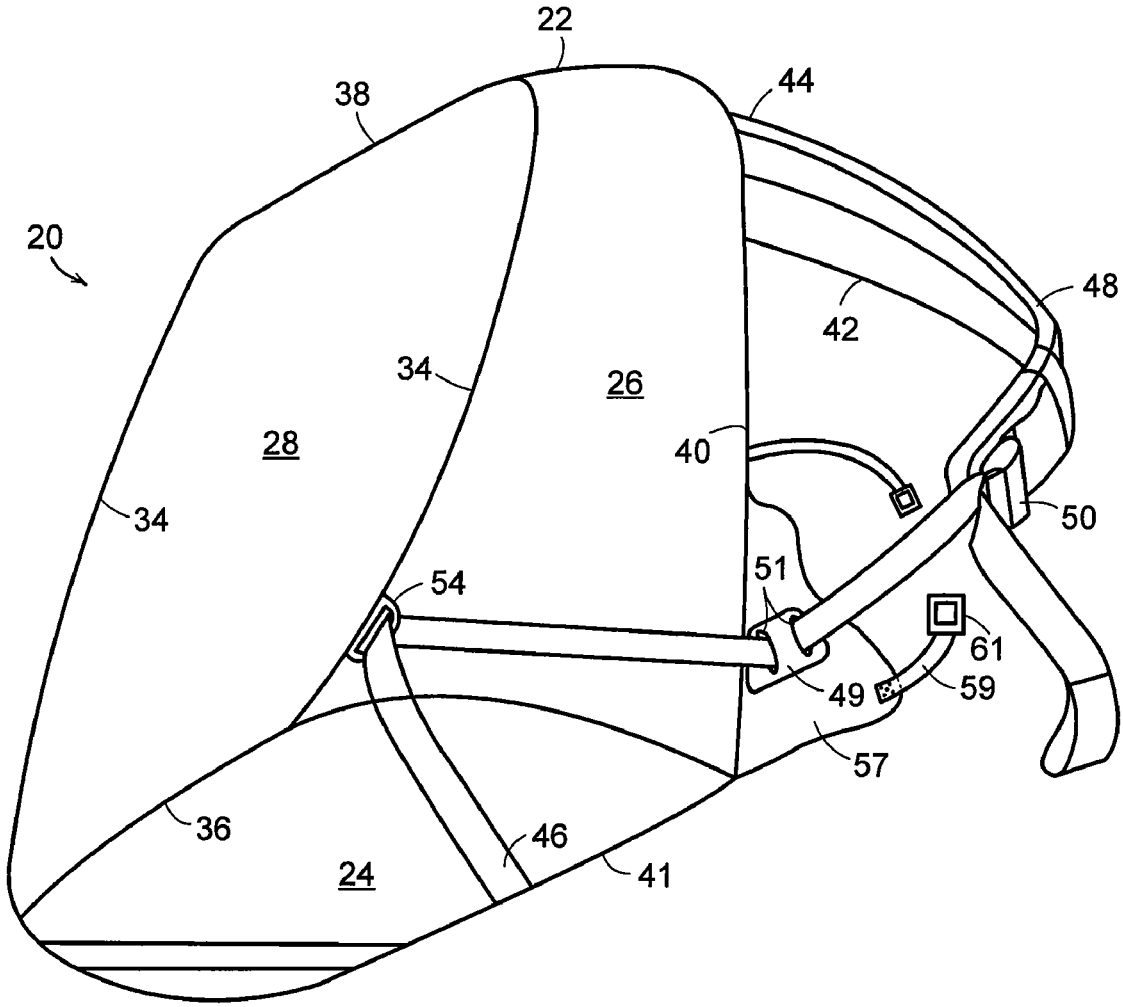
FIG. 5 is a perspective view of the backpack of FIG. 2, with another alternative embodiment of a compression assembly in accordance with the present invention.

Another preferred embodiment of compression assembly 43 is shown in FIG. 5, in which shoulder strap 42 is retained along lateral side 26 by a strap guide 49 and second D-ring 54. Strap guide 49, in the illustrated embodiment, is a piece of material secured to hip portion 57 by stitching or other suitable means. Strap guide 49 includes a pair of apertures 51 through which shoulder strap 42 passes. Strap guide 49 may be formed of the material that forms backpack body 20, leather, or any other suitable material.

Figure 6:
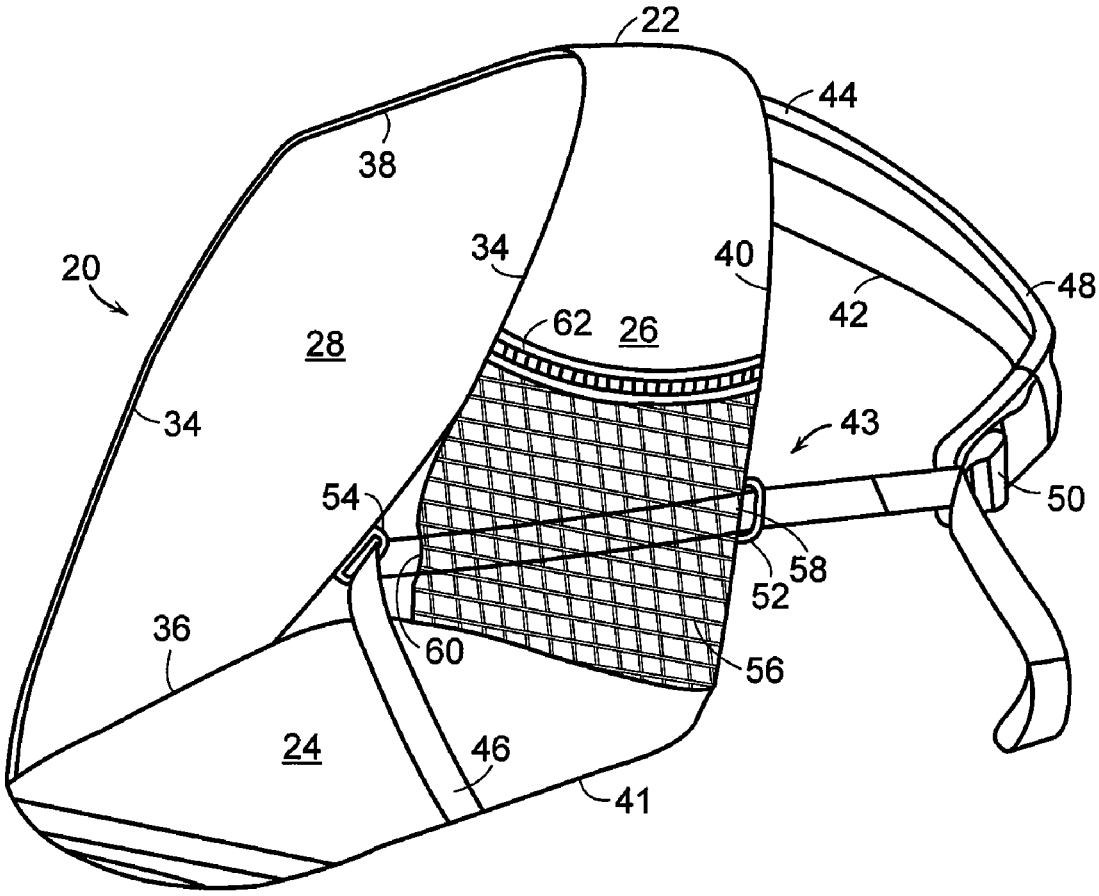
FIG. 6 is a perspective view of the backpack of FIG. 2, with yet another alternative embodiment of a compression assembly in accordance with the present invention.

Another preferred embodiment of compression assembly 43 is shown in FIG. 6, in which a pocket 56 is positioned on at least one lateral side 26, with shoulder strap 42 passing through pocket 56. A first aperture 58 is located at one side of pocket 56, proximate fifth junction 40. A second aperture 60 is located at one side of pocket 56, proximate second junction 34. Shoulder strap 42 passes through first D-ring 52, through first aperture 58, through pocket 56, out through second aperture 60 and then through second D-ring 54. Shoulder strap 42 passes freely through pocket 56 and acts as described above to automatically compress backpack body 20 when the backpack is loaded and placed on a user's shoulders. As illustrated here, shoulder strap 42 actually passes through pocket 56, and is positioned behind the fabric that forms pocket 56. It is to be appreciated that a sleeve could be incorporated within pocket 56, within which shoulder strap 42 could pass, thereby keeping shoulder strap 42 from getting encumbered by the contents of pocket 56. In this embodiment, pocket 56 is formed of a mesh material. A zipper 62 may be provided on pocket 56 to provide access to the contents of pocket 56.

Figure 7:
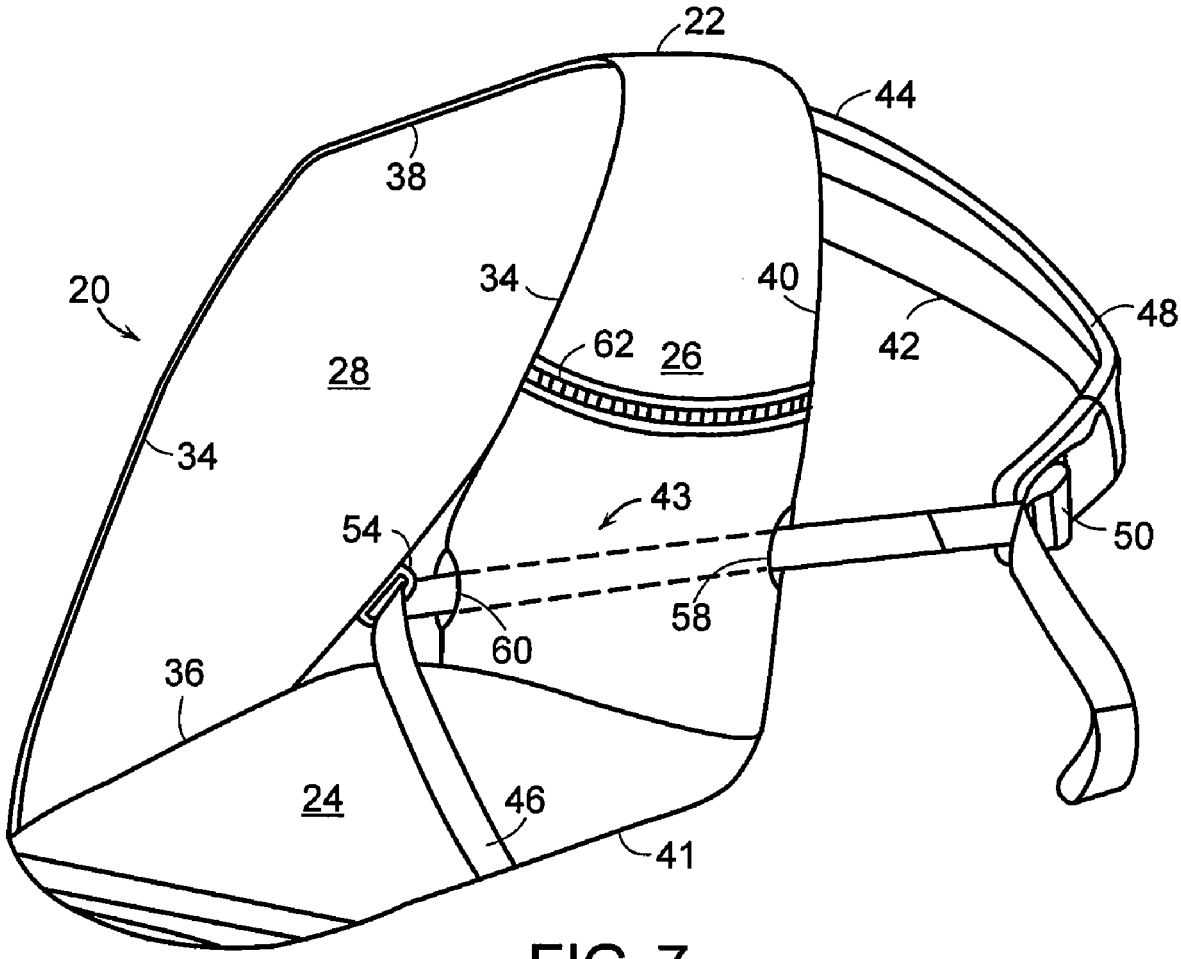
FIG. 7 is a perspective view of the backpack of FIG. 2, with another alternative embodiment of a compression assembly in accordance with the present invention.

Pocket 56 may be formed of any suitable material, including, for example, the same material that forms the remainder of backpack body 20, as illustrated in FIG. 7. FIG. 7 also illustrates an alternative embodiment, in which there is no D-ring at fifth junction 40. Rather, shoulder strap 42 is retained by first aperture 58 formed in pocket 56. In the embodiment illustrated here, a second D-ring 54 is shown. However, it is to be appreciated that second D-ring 54 could also be eliminated, such that shoulder strap would be slidably secured to lateral side 26 by pocket 56 and first and second apertures 58, 60.

Figure 8:
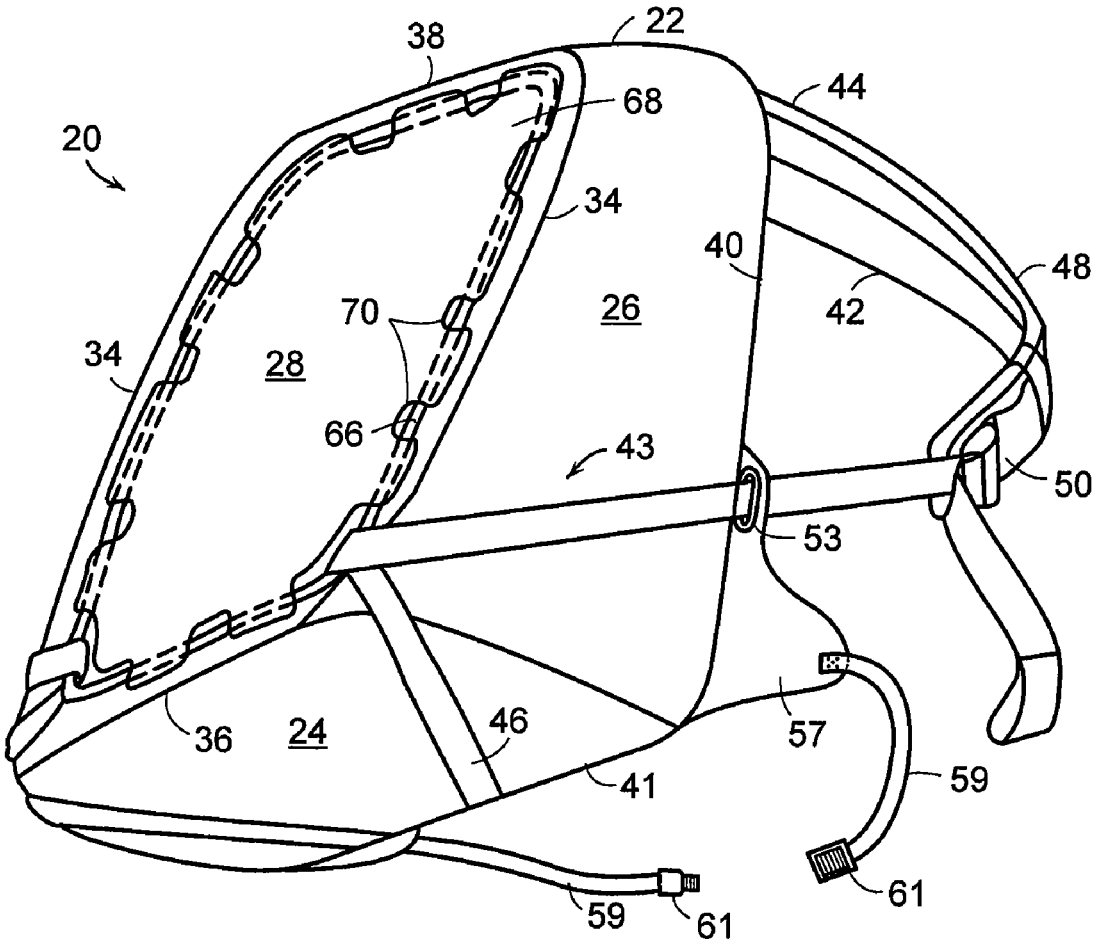
FIG. 8 is a perspective view of the backpack of FIG. 2, with another alternative embodiment of a compression assembly having a compression member in accordance with the present invention.

Another preferred embodiment of compression assembly 43 is shown in FIG. 8, in which a compression member 64 is positioned adjacent an outer surface of outer side 28 of backpack body 20. In the embodiment illustrated in FIG. 8, compression member 64 includes a ring 66 extending around a peripheral edge of outer side 28, and a retaining member 68. Ring may be, as illustrated here, a cylindrical metal rod formed of, for example, aluminum. Retaining member 68 may be, as illustrated here, a piece of fabric or other material stitched or otherwise secured to outer side 28, which maintains ring 66 adjacent outer side 28. In a preferred embodiment, a plurality of recesses 70 is formed around the periphery of retaining member 68, exposing ring 66 as it passes through each recess 70. Shoulder strap 42 extends through first D-ring 52, extends across lateral side 26, slidably wraps about an exposed length of ring 66, and extends back across bottom panel 24 to sixth junction 41. Compression member 64 acts to disperse the compressive force across outer side 28 of backpack body 20, thereby more fully compressing the load in the backpack.

Figure 9:
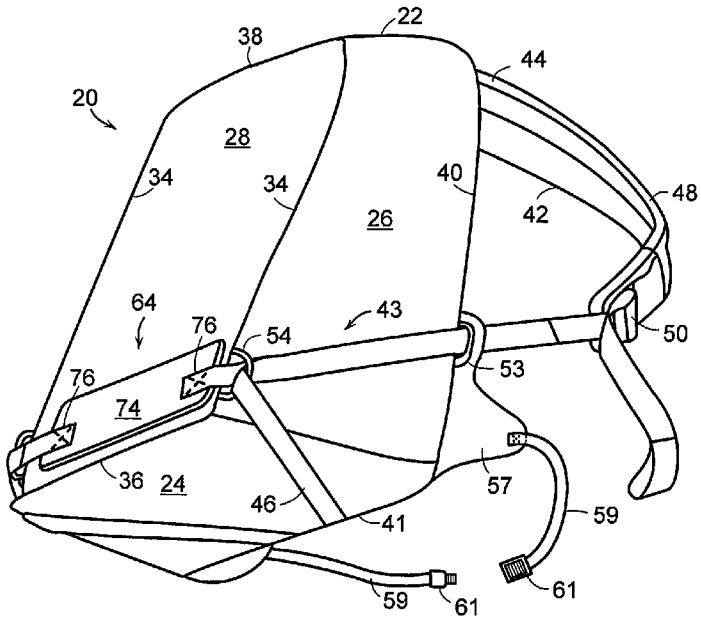
FIG. 9 is a perspective view of the backpack of FIG. 2, with another embodiment of a compression member of the compression assembly in accordance with the present invention.

Another embodiment of compression assembly 43 is illustrated in FIG. 9, in which compression member 68 comprises a compression plate 74 and a pair of retaining straps 76. Compression plate 74 is a substantially planar rectangular member that extends across outer side 28 of backpack body 20. Compression plate 74 may be formed of metal, plastic, or any other material suitable for compressing a load in backpack body 20. In the illustrated embodiment, compression plate 74 is relatively narrow and covers only a lower portion of outer side 28. It is to be appreciated that compression plate may be larger than the embodiment illustrated here, and may cover a more substantial portion of outer side 28, and may even cover substantially all of outer side 28. Retaining straps 76 are connected at opposite ends thereof to compression plate 74 and a corresponding shoulder strap 42. Retaining straps 76 serve to maintain compression plate 74 in position adjacent outer side 28. As the user dons backpack body 20, the compressive force generated by shoulder straps 42 is transmitted to compression plate 74 by way of retaining straps 76, and the compressive force is distributed across outer side 28. It is to be appreciated that a single retaining strap could be used in accordance with the present invention, with opposite ends thereof secured to corresponding shoulder straps 42, and a central portion thereof secured to compression plate 74. In certain preferred embodiments, compression plate may be housed in a pocket or sleeve of backpack body 20, formed as part of backpack body 20, or stitched or otherwise secured to outer side 28.

Figure 10:
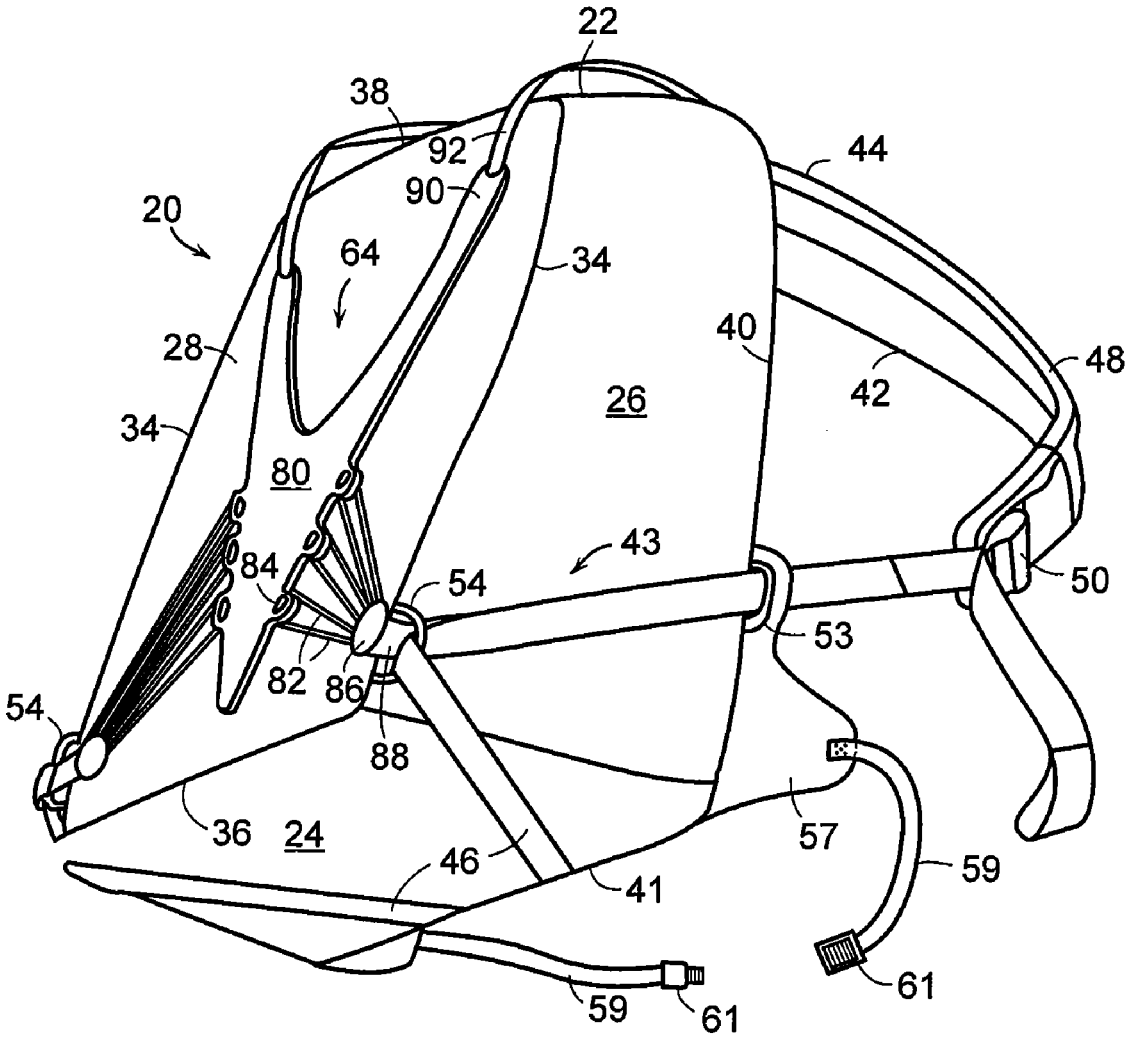
FIG. 10 is a perspective view of the backpack of FIG. 2, with yet another embodiment of a compression member of the compression assembly in accordance with the present invention.

Compression member 64 may take many forms and/or shapes, such as rectangular, circular, etc., and may extend across a small portion or a majority of the surface of outer side 28. In one preferred embodiment, compression member 64 takes the form of a substantially V-shaped member 80, as illustrated in FIG. 10. Each of a plurality of retaining straps 82 is connected at a first end thereof to shoulder straps 42 and at a second end thereof to V-shaped member 80. In a preferred embodiment, three flanges 84 are formed on each of opposed sides of V-shaped member 80, with a pair of retaining straps 82 being secured to each flange 84. The first ends of retaining straps 82 may be secured to shoulder straps 42 by way of an anchoring member, such as a disk 86, which is in turn connected to shoulder strap 42 by way of a connecting strap 88. Retaining straps 82 may be elastic cords, webbing, or any other suitable elongate member that can connect V-shaped member 80 to shoulder straps 42.

Upper ends 90 of V-shaped member 80 may be secured to upper ends 44 of shoulder straps 42. In a preferred embodiment, load lift straps 92 extend from upper ends 90 of V-shaped member 80 to upper ends 44 of shoulder straps 42. Load lift straps 92 serve to maintain the upper portion of V-shaped member adjacent outer side 28, and also help to compress the load in backpack body 20.

In light of the foregoing disclosure of the invention and description of the preferred embodiments, those skilled in this area of technology will readily understand that various modifications and adaptations can be made without departing from the scope and spirit of the invention. All such modifications and adaptations are intended to be covered by the following claims.

What is claimed is:

1. A backpack with a compression system comprising, in combination:

a backpack body having a top side, a bottom side, two lateral sides, a body side and an outer side;

a pair of shoulder straps, each shoulder strap having a first end connected at a junction of the top side and the body side, and a second end connected to the backpack body at a junction of the bottom side and the body side, the strap extending along a corresponding lateral side and the bottom of the backpack body, and being slidably connected to the backpack body at a junction of the body side and a corresponding lateral side, and at a junction of the corresponding lateral side and the outer side.

2. The backpack of claim 1, wherein the shoulder straps are slidably connected to the backpack body by way of a D-ring.

3. The backpack of claim 1, wherein the shoulder straps are slidably connected to the backpack body by way of a grommet.

4. The backpack of claim 1, wherein the shoulder straps are slidably connected to the backpack body by way of a strap guide.

5. The backpack of claim 1, further comprising hip portions secured to the junctions between corresponding lateral sides and the body side.

6. The backpack of claim 5, wherein the shoulder straps are slidably connected to the backpack body by way of a grommet secured to a corresponding hip portion.

7. The backpack of claim 5, wherein the shoulder straps are slidably connected to the backpack body by way of a strap guide secured to a corresponding hip portion.

8. The backpack of claim 5, further comprising a hip strap connected at opposite ends thereof to the hip portions.

9. The backpack of claim 1, further comprising a pocket formed on at least one lateral side of the backpack body, with a corresponding shoulder strap passing through the pocket.

10. The backpack of claim 9, wherein an aperture is formed on each side of the pocket, the shoulder strap passing through each of the apertures.

11. The backpack of claim 9, wherein the pocket is formed of webbing.

12. The backpack of claim 1, further comprising a compression member positioned adjacent the outer side of the backpack body and connected to the shoulder straps.

13. The backpack of claim 12, wherein the compression member is a substantially planar member that extends along a lower portion of the outer side of the backpack body.

14. The backpack of claim 12, wherein the compression member comprises a ring, the shoulder straps passing through the ring.

15. The backpack of claim 14, further comprising a retaining member secured to the outer side of the backpack body, the ring positioned between the retaining member and the outer side of the backpack body.

16. The backpack of claim 15, wherein the retaining member comprises a piece of fabric sewn to the outer side of the backpack body.

17. The backpack of claim 12, wherein the compression member comprises a substantially V-shaped member.

18. The backpack of claim 17, wherein upper ends of the substantially V-shaped member are connected to upper ends of corresponding shoulder straps.

19. The backpack of claim 18, wherein each upper end of the substantially V-shaped member is connected to an upper end of a corresponding shoulder strap by a load lift strap.

20. The backpack of claim 1, wherein each shoulder strap is slidably connected to the junction of the body side and a corresponding lateral at a higher position than the location at which the shoulder strap is slidably connected to the junction of the corresponding lateral side and the outer side.

21. The backpack of claim 1, wherein the shoulder straps are configured such that the backpack body is automatically compressed upon lifting of the backpack body when the backpack body is loaded.

22. A backpack with a compression system comprising, in combination:

a backpack body having a top side, a bottom side, two lateral sides, a body side and an outer side; and a compression assembly comprising a pair of shoulder straps, each shoulder strap having a first end connected at a junction of the top side and the body side, and a second end connected to the backpack body at a junction of the bottom side and the body side, the strap extending along a corresponding lateral side and the bottom of the backpack body, and being slidably connected to the backpack body at a junction of the body side and a corresponding lateral side, and at a junction of the corresponding lateral side and the outer side; and a compression member positioned adjacent an outer surface of the outer side and secured to each of the shoulder straps;

wherein each shoulder strap is slidably connected to the junction of the body side and a corresponding lateral side at a higher position than the location at which the shoulder strap is slidably connected to the junction of the corresponding lateral side and the outer side.

23. The backpack of claim 22, wherein the shoulder straps are slidably connected to the backpack body by way of a D-ring.

24. The backpack of claim 22, wherein the shoulder straps are slidably connected to the backpack body by way of a grommet.

25. The backpack of claim 22, wherein the shoulder straps are slidably connected to the backpack body by way of a strap guide.

26. The backpack of claim 22, further comprising hip portions secured to the junctions between corresponding lateral sides and the body side.

27. The backpack of claim 26, further comprising a hip strap connected at opposite ends thereof to the hip portions.

28. A backpack with a compression system comprising, in combination:

a backpack body having a top side, a bottom side, two lateral sides, a body side and an outer side;

a pair of shoulder straps, each shoulder strap having a first end connected at a junction of the top side and the body side, and a second end connected to the backpack body at a junction of the bottom side and the body side, the strap extending along a corresponding lateral side and the bottom of the backpack body, and being slidably connected to the backpack body at a junction of the body side and a corresponding lateral side, and at a junction of the corresponding lateral side and the outer side such that the lateral sides will automatically compress and a portion of each shoulder strap between the first end and the junction of the body side and the corresponding lateral side will lengthen when a loaded backpack is lifted.

* * * * *